US009825390B2

(12) United States Patent
Chen et al.

(10) Patent No.: US 9,825,390 B2
(45) Date of Patent: Nov. 21, 2017

(54) CONNECTION APPARATUS USABLE IN VACUUM INTERRUPTER

(71) Applicant: EATON CORPORATION, Cleveland, OH (US)

(72) Inventors: Qing Qi Chen, Xiamen (CN); Li Hua Bao, Jiangsu (CN); Yi Feng Wang, Jiangsu (CN); Yudong Tian, Jiangs (CN)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/287,920

(22) Filed: Oct. 7, 2016

(65) Prior Publication Data

US 2017/0025776 A1 Jan. 26, 2017

Related U.S. Application Data

(62) Division of application No. 14/562,837, filed on Dec. 8, 2014, now Pat. No. 9,570,826.

(51) Int. Cl.
*H01R 13/02* (2006.01)
*H01H 33/666* (2006.01)
(Continued)

(52) U.S. Cl.
CPC ..... *H01R 13/02* (2013.01); *H01H 27/04* (2013.01); *H01H 33/025* (2013.01); *H01H 33/666* (2013.01); *H01H 1/5822* (2013.01)

(58) Field of Classification Search
CPC ..... H01H 33/666; H01H 1/5822; H01H 1/54; H01H 27/04; H01H 33/025; H01H 1/50;
(Continued)

(56) References Cited

U.S. PATENT DOCUMENTS 3,469,048 A * 9/1969 Streater ..... H01H 33/66 218/118
3,594,525 A * 7/1971 Miller ..... H01H 33/008 200/337

(Continued)

FOREIGN PATENT DOCUMENTS

DE 89 12 897 U1 12/1989
FR 2 339 243 A1 8/1977
FR 2 556 511 A1 6/1985

OTHER PUBLICATIONS

European Patent Office, "International Search Report and Written Opinion" (for corresponding application PCT/US2015/054619), dated Jan. 4, 2016, 10 pp.

*Primary Examiner* — Truc Nguyen
(74) *Attorney, Agent, or Firm* — Eckert Seamans; Brij Agarwal; Grant Coffield

(57) ABSTRACT

An improved connection apparatus that meets these and other needs includes, in one embodiment, an approximately J-shaped flexible conductor having at its end an opening that receives therethrough a portion of the shank for mechanical and electrical connection therebetween. The conductor further includes a hole formed therein at approximately its midpoint that receives therein, in a movable and non-contacting fashion, another portion of the elongated shank. In another pair of embodiments, another connection apparatus includes a flexible conductor that is co-formed with a rigid conductor to form a single piece unitary element. The free end of the flexible conductor is connected with the movable shank, and the rigid conductor is connectable with the primary conductor of the circuit. By providing the flexible conductor and the rigid conductor as a co-formed unit, a detachable fastener need not be employed to provide a connection therebetween, which reduces heat generation.

6 Claims, 7 Drawing Sheets

(51) Int. Cl.
*H01H 33/02* (2006.01)
*H01H 27/04* (2006.01)
*H01H 1/58* (2006.01)

(58) Field of Classification Search
CPC ..... H01H 3/50; H01H 3/60; H01H 79/00; H01H 9/20; H01H 2033/66246; H01H 2033/6667; H01H 31/20; H01H 33/02; H01H 33/022
See application file for complete search history.

(56) References Cited

U.S. PATENT DOCUMENTS 4,101,748 A * 7/1978 Meyer ..... H01H 33/12 200/82 B
4,153,827 A * 5/1979 Mircovich ..... H01H 33/12 218/26
5,668,361 A 9/1997 Moncke et al.
6,140,894 A * 10/2000 Lane ..... H01H 77/101 218/22
6,410,875 B2 * 6/2002 Allard ..... H01H 1/5822 218/118
7,098,418 B1 * 8/2006 Yamada ..... H01H 1/0015 218/120
8,115,124 B2 * 2/2012 Maruyama ..... H01H 1/5822 200/50.27
2001/0040146 A1 * 11/2001 Miyo ..... H01H 33/662 218/118
2002/0043515 A1 * 4/2002 Kajiwara ..... H01H 33/666 218/118
2002/0043516 A1 * 4/2002 Morita ..... H01H 33/66207 218/118
2006/0121799 A1 * 6/2006 Maura ..... H01H 1/5822 439/874
2009/0218319 A1 * 9/2009 Kagawa ..... H01H 33/6606 218/140
2009/0255905 A1 * 10/2009 Lee ..... H01H 33/6606 218/139
2013/0314827 A1 * 11/2013 Sohn ..... H01H 71/125 361/57
2014/0374226 A1 * 12/2014 Narayanasamy .... H01H 1/5822 200/237

* cited by examiner

CONNECTION APPARATUS USABLE IN VACUUM INTERRUPTER

CROSS REFERENCE TO RELATED APPLICATION

The instant application claims priority from U. S. patent application Ser. No. 14/562,837 filed Dec. 8, 2014, the disclosures of which are incorporated herein by reference.

BACKGROUND

Field

The disclosed and claimed concept relates generally to electrical interruption equipment and, more particularly, to a flexible connection apparatus that is configured to provide an electrical connection between a vacuum interrupter and another conductor.

Related Art

Various types of electrical interruption devices are well known in the relevant art. Such electrical interruption devices are known to include circuit breakers, fuses, vacuum interrupters, and numerous such other devices. Such devices are configured to open a protected portion of a circuit in certain overcurrent and under-voltage conditions, as well as in other conditions. While such devices have been generally effective for their intended purposes, they have not been without limitation.

As is generally understood, a vacuum interrupter typically includes a vacuum bottle that contains a stationary contact and a movable contact within an evacuated environment. The movable contact is connected with an elongated shank that extends outside the evacuated region and that is connectable with an operating mechanism to change the state of the vacuum interrupter, i.e., to move the set of contacts between an OPEN condition and a CLOSED condition. Such vacuum interrupters further include a flexible connector that is electrically conductive and that flexibly extends between the movable shank and another conductor such as a primary conductor of the circuit. Since vacuum interrupters by their nature employ a translating conductive element (movable contact and shank) rather than a pivoting one (such as a moving contact arm in a circuit breaker), the flexible connector that extends between the shank and the other conductor must move a relatively great distance when the vacuum interrupter changes states and thus typically experiences significant stress and strain. Eventually, such connectors can fail, which is undesirable and is preferably avoided. Improvements therefore would be desirable.

SUMMARY

An improved connection apparatus that meets these and other needs includes, in one embodiment, an approximately J-shaped flexible conductor having at its end an opening that receives therethrough a portion of the shank for mechanical and electrical connection therebetween. The conductor further includes a hole formed therein at approximately its midpoint that receives therein, in a movable and non-contacting fashion, another portion of the elongated shank. The approximately J-shaped conductor is of a greater length than other such conductors that are known in the art, and such increased length reduces the stress and strain in the improved conductor, as compared with previously known conductors that are not J-shaped. In another pair of embodiments, another connection apparatus includes a flexible conductor that is co-formed with a rigid conductor to form a single piece unitary element. The free end of the flexible conductor is connected with the movable shank, and the rigid conductor is connectable with the primary conductor of the circuit. By providing the flexible conductor and the rigid conductor as a co-formed unit, a detachable fastener need not be employed to provide a connection therebetween, which reduces heat generation and extends the lifespan of the connection apparatus.

Accordingly, an aspect of the disclosed and claimed concept is to provide an improved connection apparatus that is usable in a vacuum interrupter.

Another aspect of the disclosed and claimed concept is to provide such a connection apparatus that is flexible and is of a relatively greater length than previously known connectors to reduce the stress and strain in the connection apparatus when the vacuum interrupter changes state.

Another aspect of the disclosed and claimed concept is to provide an improved connection apparatus wherein a flexible conductor and a rigid conductor are co-formed as a single piece unitary member.

Accordingly, an aspect of the disclosed and claimed concept is to provide an improved connection apparatus that is structured to be electrically connected between a movable conductor of a circuit interrupter and another conductor that is stationary, the movable conductor having an elongated shank that is structured to be connected with an operating mechanism which is structured to move the shank along a movement axis to change the state of the circuit interrupter. The connection apparatus can be generally stated as including an elongated and flexible conductor having formed therein a hole that is structured to movably receive therein a portion of the shank, a first end of the conductor forming a first connector and having formed therein an opening that is structured to receive therein another portion of the shank and to be electrically connected with the another portion of the shank, and a second connector situated at a second end of the conductor and being structured to be electrically connected with the another conductor Another aspect of the disclosed and claimed concept is to provide an improved connection apparatus that is structured to be electrically connected between a movable conductor of a circuit interrupter and another conductor that is stationary, the circuit interrupter being situated on an insulator, the movable conductor having an elongated shank that is structured to be connected with an operating mechanism which is structured to move the shank to change the state of the circuit interrupter, at least a portion of the insulator being situated generally between the shank and the another conductor. The connection apparatus can be generally stated as including an elongated and flexible conductor formed of a braid of conductive material, at least a portion of the conductor being structured to be received through an aperture formed in the insulator, a first end of the conductor forming a first connector and having formed therein an opening that is structured to receive therein a portion of the shank and to be electrically connected with the portion of the shank, and a second connector connected with the conductor at a second end thereof and being structured to be electrically connected with the another conductor, the second connector being of an approximately plate-like shape whose major dimensions extend in a direction generally transverse to the longitudinal extent of the conductor, the second connector being structured to be situated against the insulator when the conductor is received through the aperture.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
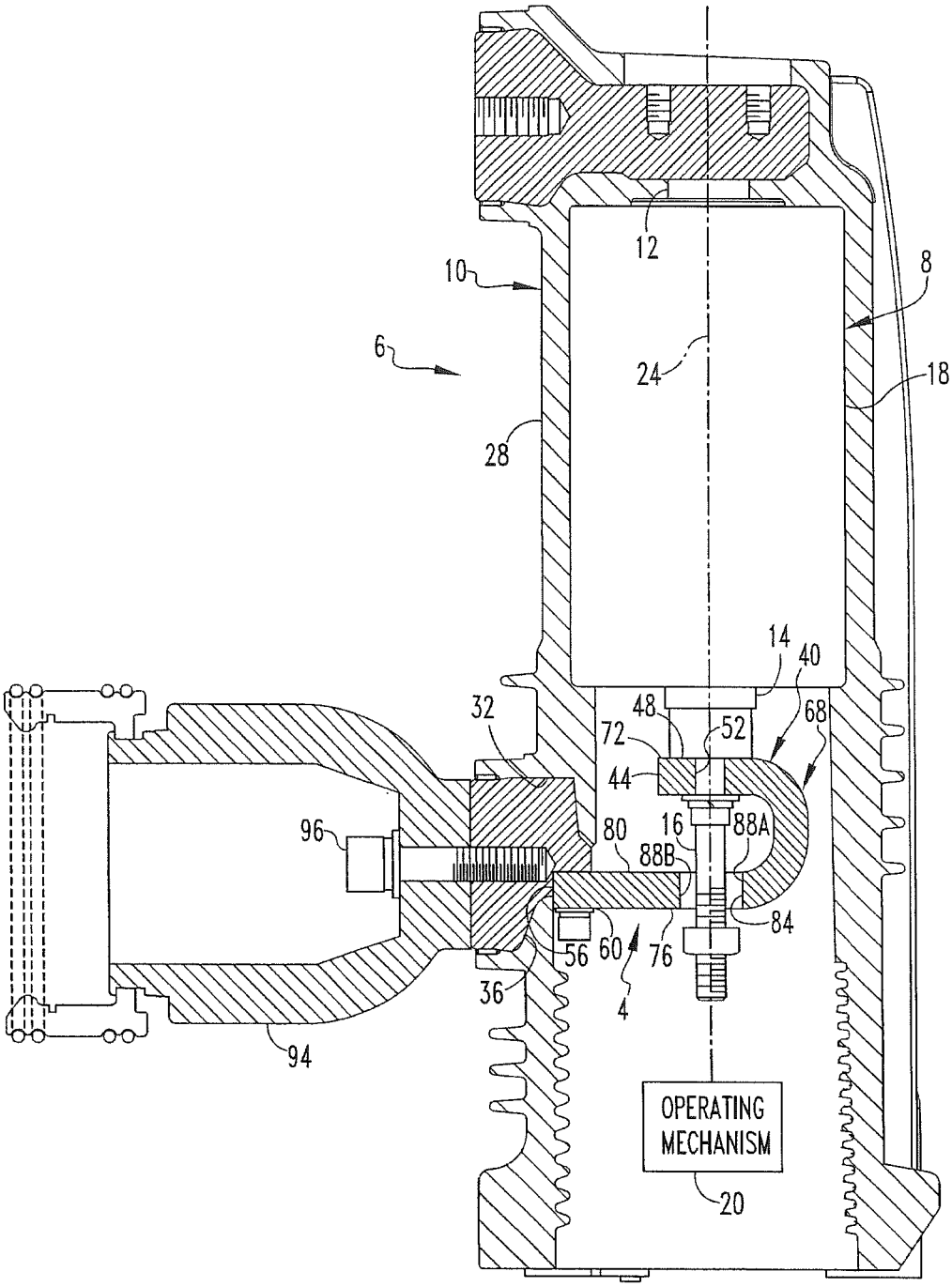
FIG. 1 depicts an improved connection apparatus, partially cut away, in accordance with a first embodiment of the disclosed and claimed concept installed in an improved interruption apparatus, partially cut away, that is likewise in accordance with the disclosed and claimed concept.

An improved connection apparatus 4 in accordance with a first embodiment of the disclosed and claimed concept is depicted in FIG. 1 as being a part of an improved interruption apparatus 6 that is likewise in accordance with the disclosed and claimed concept. The connection apparatus 4 is further depicted individually in FIGS. 2 and 3.

The interruption apparatus 6 can be generally described as including the connection apparatus 4, a circuit interrupter 8 which, in the depicted exemplary embodiment, is a vacuum interrupter, and an insulator 10 upon which the circuit interrupter 8 is situated. As will be set forth in greater detail below, the connection apparatus 4 flexibly extends between and electrically connects together the circuit interrupter 8 and a conduction device 36 that is mounted to the insulator 10.

The circuit interrupter 8 is depicted herein as being a conventional vacuum interrupter having a stationary conductor 12 and a movable conductor 14, with the movable conductor 14 being movable to change the state of the circuit interrupter by moving the stationary and movable contacts 12 and 14 between an OPEN condition and a CLOSED condition. The movable conductor 14 has an elongated shank 16 that extends therefrom and that is generally rigid and is movable along a movement axis 24. The circuit interrupter 8 further includes a vacuum bottle 18 within which is maintained an evacuated region and within which the stationary and movable conductors 12 and 14 are situated. The shank 16 protrudes from the exterior of the bottle 18 and is connected with an operating mechanism 20 that is configured to move the shank 16 along the movement axis 24 to thereby cause the circuit interrupter 8 to change states between the OPEN condition and the CLOSED condition.

The insulator 10 includes at least a first wall 28 which has an aperture 32 formed therein within which the conduction device 36 is disposed. In some configurations, the material of the wall 28 may be molded in situ about the conduction device 36, whereby the conduction device 36 would generally be considered to be a part of the insulator 10, although this need not necessarily be the case. As will be set forth in greater detail below, the conduction device 36 is electrically connectable with an additional conductor 94 that may be part of a main conductor of a protected circuit. While the wall 28 is formed of an electrically insulative material, the conduction device 36 is formed of an electrically conductive material such as copper or another metal, by way of example.

Figure 2:
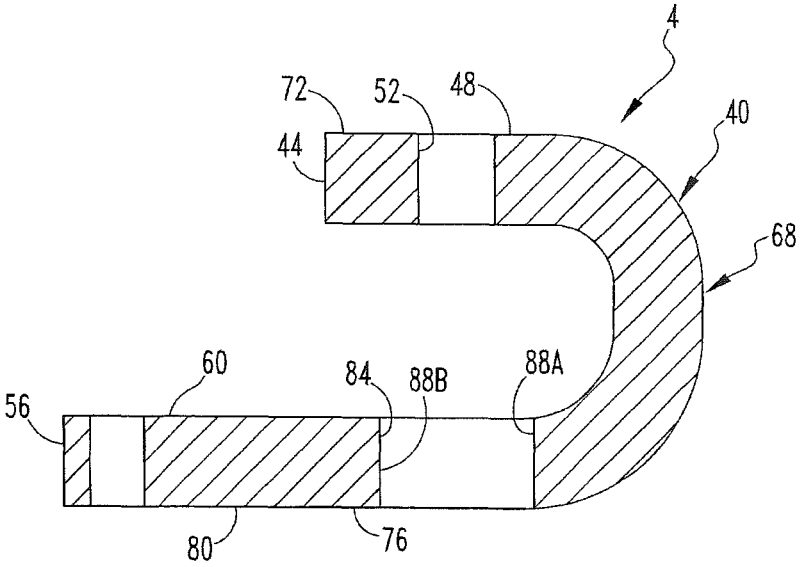
FIG. 2 is a partially cut away side view of the connection apparatus of FIG. 1.

The improved connection apparatus 4 can be said to include a conductor 40 that is elongated and flexible. In the depicted exemplary embodiment, the conductor 40 is a conductive braid that is formed from strands of a flexible conductive material such as copper or other appropriate material. As can be seen in FIGS. 1 and 2, the conductor 40 is approximately J-shaped, although other shapes can be employed depending upon the needs of the particular application.

Figure 3:
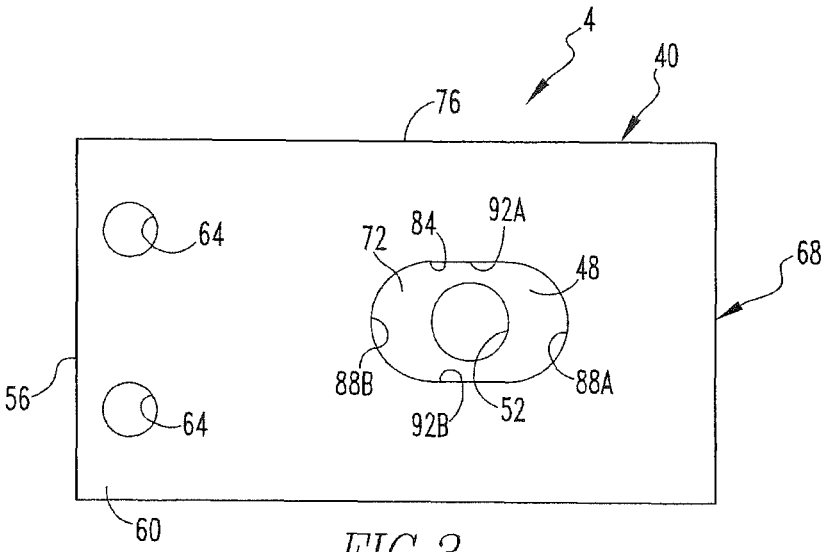
FIG. 3 is a bottom plan view of the connection apparatus of FIG. 2.

The conductor 40 has a first end 44 that forms a first connector 48 having a first opening 52 formed therein. The first connector 48 is electrically connected with the circuit interrupter 8 by receiving a portion of the shank 16 in the first opening 52 and affixing the two together with an appropriate fastener. A second end 56 of the conductor 40 opposite the first end 44 forms a second connector 60 having formed therein a pair of second openings 64 which are depicted in FIG. 3. The second connector 60 is connected with the conduction device 36 in a fashion that will be set forth in greater detail below.

The conductor 40, being approximately J-shaped as mentioned above, can be said to include a loop portion 68 that is approximately U-shaped and that has a first leg 72 and a second leg 76 which are opposite one another. The conductor 40 further includes a connection portion 80 that is elongated and that extends from the second leg 76. The first opening 52 is formed in the first leg 72, and the pair of second openings 64 are formed in an end of the connection portion 80 opposite the second leg 76.

The second leg 76 advantageously has a hole 84 that is formed therein at approximately the midpoint of the conductor 40 and through which a portion of the shank 16 slides in a non-contacting fashion when it moves along the movement axis 24, such as when the circuit interrupter 8 changes states. As can be seen from FIG. 3, not only is the hole 84 larger than the first opening 52 and the cross-sectional dimension of the shank 16, it additionally is elongated along the direction of elongation of the conductor 40. That is, the hole 84 has a pair of opposite ends 88A and 88B and a pair of opposite sides 92A and 92B, and the ends 88A and 88B are spaced farther apart than the sides 92A and 92B.

The conductor 40 is attached to the conduction device 36 through the use of a pair of threaded fasteners 96 that extend through the second openings 64 and that are threadably received in receptacles formed in the conduction device 36. It is understood, however, that the conductor 40 can be connected with the conduction device 36 in other fashions without departing from the present concept.

As can be understood from FIG. 1, the loop portion 68 is situated generally at one side of the shank 16, which is to the right in FIG. 1, and the connection portion 80 and the conduction device 36 are situated generally at an opposite side of the shank, which is to the left in FIG. 1. When the shank 16 is moved along the movement axis 24, which is in the vertical direction from the perspective of FIG. 1, it can be understood that generally the entire extent of the conductor 40 between the first opening 52 and the pair of second openings 64 becomes at least slightly elastically deformed. Since the conductor 40 extends from its connection with the shank 16, i.e., at the first opening 52, in a direction generally toward the first direction (i.e., the right of FIG. 1) and then returns back upon itself to extend generally in the second direction (to the left in FIG. 1), the elongated conductor 40 is of a relatively longer length than previously known flexible conductors that were used in the same type of application. The advantageous result is that the relatively longer improved conductor 40 experiences relatively less stress and strain when the shank 16 moves along the movement axis 24 during a change in state of the circuit interrupter 8. Such increased length is enabled because the conductor 40 has the hole 84 formed therein through which the shank 16 is reciprocatingly and non-contactingly movable.

It can be understood that the elongation of the hole 84 along the longitudinal extent of the conductor 40 further aids the non-contacting reception of the shank 16 in the hole 84 in situations where the conductor 40 becomes elastically deformed in the vertical direction from the perspective of FIG. 1. Such vertical deformation of the conductor 40 causes the hole 84 to move in the horizontal direction from the perspective of FIG. 1 with respect to the movement axis 24. The shape of the conductor 40 and the provision of the hole 84 therein thus enables the conductor 40 to be of a relatively greater length for reduced stress and strain thereon, which advantageously provides longer life to the conductor 40.

Figure 4:
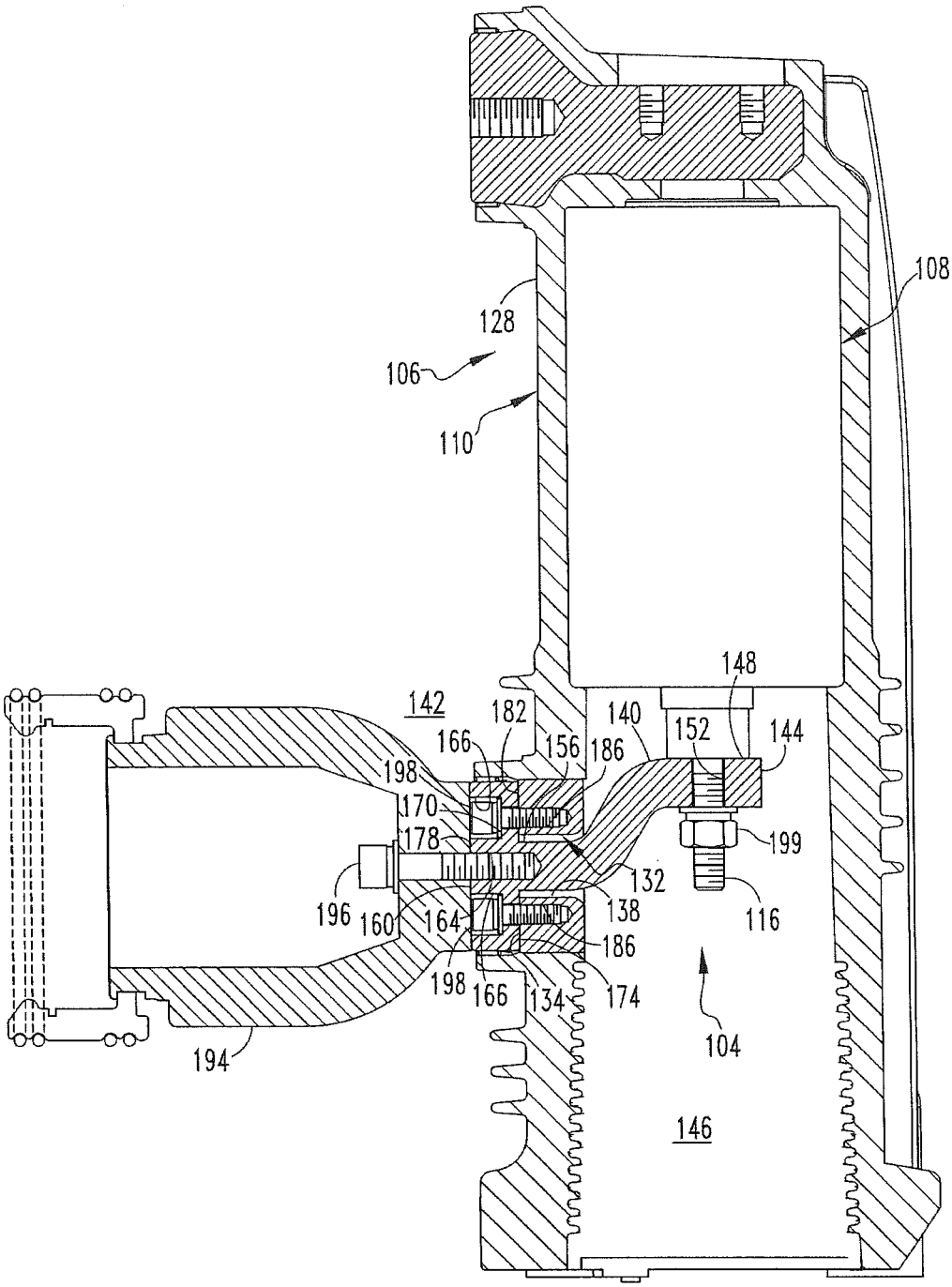
FIG. 4 is a partially cut away depiction of an improved connection apparatus in accordance with a second embodiment of the disclosed and claimed concept installed in an improved interruption apparatus, partially cut away, that is likewise in accordance with the disclosed and claimed concept.

An improved connection apparatus 104 in accordance with a second embodiment of the disclosed and claimed concept is depicted in FIG. 4 as being a part of an improved interruption apparatus 106 that is likewise in accordance with the disclosed and claimed concept. The interruption apparatus 106 includes a circuit interrupter 108 that is functionally identical to the circuit interrupter 8 and includes an elongated shank 116 that is connectable with an operating mechanism such as the operating mechanism 20 to move the interruption apparatus 106 between its OPEN and CLOSED positions to thereby change the state of the circuit interrupter 108. The circuit interrupter 108 is likewise situated on an insulator 110 having a wall 128, but the wall 128 has formed therein an aperture 132 that is different from the aperture 32 of the interruption apparatus 6.

Figure 8:
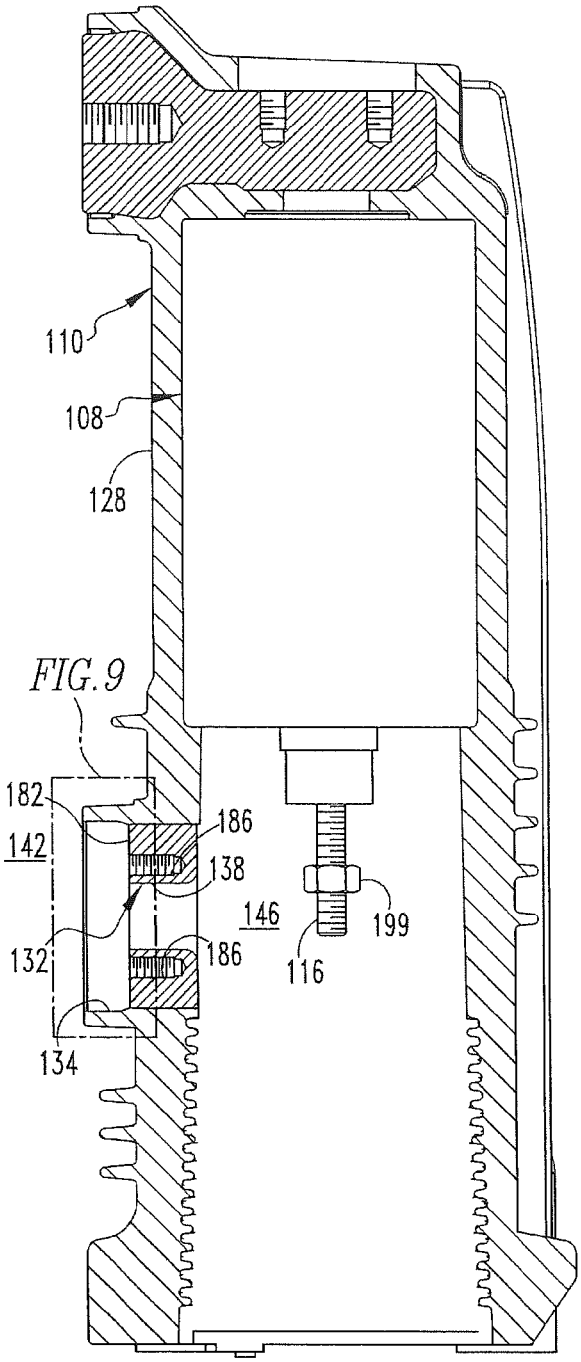
FIG. 8 is a partially cut away side view of a circuit interrupter and an insulator that are usable in connection with the connection apparatus of FIG. 5 to form the interruption apparatus of FIG. 4.
Figure 9:
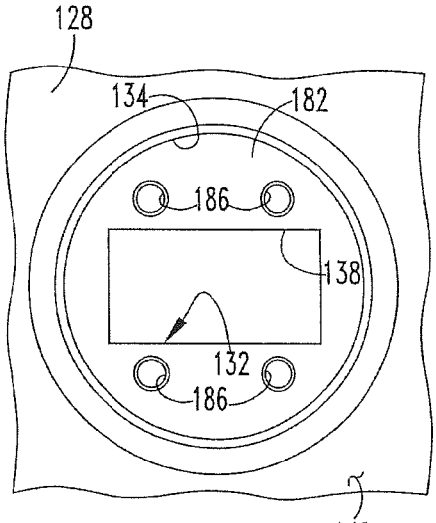
FIG. 9 is an enlarged end view of the indicated portion of FIG. 8.

More particularly, and as is best depicted in FIGS. 8 and 9, the aperture 132 includes an approximately cylindrical seat 134 that is recessed in the wall 128 and further includes a channel 138 that is of an approximately rectangular cross-sectional shape and that extends from the seat 134 to an interior region of the insulator 110. The seat 134 can be stated to be situated generally at an exterior side 142 of the wall 128, i.e., generally at the exterior of the insulator 110, and the channel 138 can be said to be situated generally at an interior side 146 of the wall 128, i.e., generally within the interior of the insulator 110.

As can be understood from FIGS. 4 and 5, the connection apparatus 104 can be said to include a flexible conductor 140 which, as will be set forth in greater detail below, is affixed to and electrically connected with a rigid conductor 160. The flexible conductor 140 is elongated and is formed of a braid of flexible conductive material in the fashion similar to the conductor 140 and has a first end 144 that forms a first connector 148 having a first opening 152. The shank 116 is received in the opening 152, and the two are affixed together and are electrically connected together through the use of a nut 199. A second end 156 of the flexible conductor 140 opposite the first end 144 is affixed to and electrically connected with the rigid conductor 160 in a fashion that causes the connection apparatus 104 to be co-formed as a unitary and single piece element.

Figure 5:
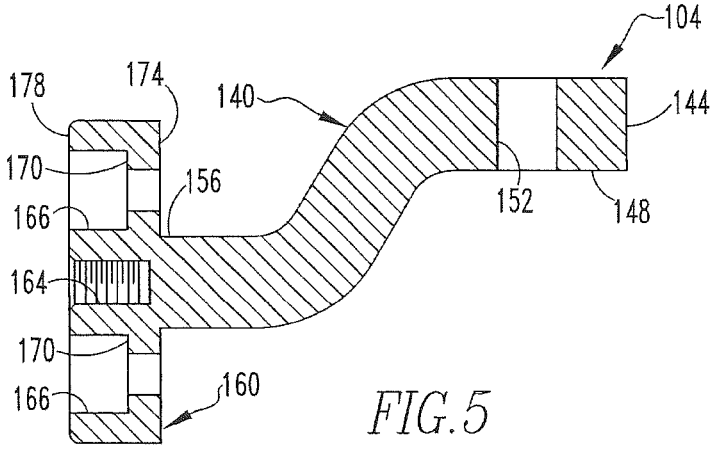
FIG. 5 is a side view, partially cut away, of the connection apparatus of FIG. 4.
Figure 6:
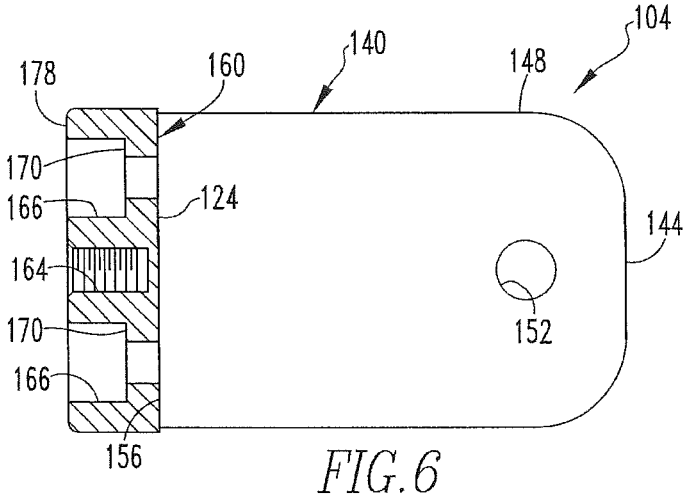
FIG. 6 is a top plan view, partially cut away, of the connection apparatus of FIG. 5.
Figure 7:
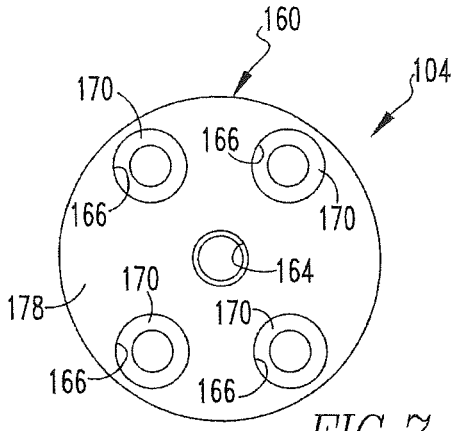
FIG. 7 is an end view of the connection apparatus of FIG. 5.

In the depicted exemplary embodiment, and as can be understood from FIGS. 5-7, the rigid conductor 160 is of a rounded, plate-like configuration and is formed of a conductive material which, in the depicted exemplary embodiment, is a solid plate of copper. The expression "rigid" as employed herein refers to the property of being generally non-flexible within the range of forces that the interruption apparatus 106 is typically expected to experience. The flexible conductor 140 is relatively more flexible than the rigid conductor 160.

The flexible conductor 140 and the rigid conductor 160 can be affixed together to form the co-formed unitary element in any of a wide variety of fashions such as through welding, brazing, and the like. Such joinder causes the flexible and rigid conductors 140 and 160 to be affixed to one another and to be electrically connected together. The rigid conductor 160 can, in turn, be electrically connected with an additional conductor 194 which is depicted in an exemplary fashion in FIG. 4 as being substantially identical to the additional conductor 94.

In this regard, it can be seen from FIGS. 5-7 that the rigid conductor 160 has formed therein a central opening 164 that is internally threaded. The rigid conductor 160 further has formed therein a plurality of peripheral openings 166 that each include a ledge 170 that faces in a direction generally away from the seat 134 when the rigid conductor 160 is received therein. The rigid conductor 160 can be said to include a generally circular first surface 174 that faces generally toward the flexible conductor 140 and to which the flexible conductor 140 is attached. The rigid conductor 160 further includes a generally circular second surface 178 that is opposite the first surface 174 and that faces generally away from the interruption apparatus 106 and is engaged by the additional conductor 194.

The seat 134 itself can be said to include a generally flat engagement surface 182 against which the first surface 174 is receivable. As can best seen in FIGS. 8 and 9, the insulator 110 has a plurality of receptacles 186 formed in the engagement surface 182 that are threaded and that are configured to threadably receive therein a set of peripheral fasteners 198 to attach the connection apparatus 104 to the insulator 110 within the aperture 132. More particularly, the peripheral fasteners 198 are first received in the peripheral openings 166 and are then received in the receptacles 186. The peripheral fasteners 198 are tightened within the receptacles 186 sufficiently to cause the heads of the peripheral fasteners 198 to compressively engage the ledges 170, to thereby compress the rigid conductor 160 into engagement with the engagement surface 182. In such a situation, the flexible conductor 140 is received through the channel 138, and the opening 152 at the first end 144 of the flexible conductor 140 can be attached to the shank 116. It is noted that FIG. 4 depicts the first connector 148 and the shank 116 already being mechanically and electrically connected together. The additional conductor 194 can then be mechanically and electrically connected with the rigid conductor 160 through the use of a central fastener 196 threadably received in the central opening 164, as is depicted in FIG. 4.

By advantageously configuring the connection apparatus 104 to include the flexible conductor 140 and the rigid conductor 160 being electrically connected together and being co-formed as a single piece unitary element, the generally inseparable connection between the flexible conductor 140 and the rigid conductor 160 avoids the use of removable fasteners to provide such a connection. That is, it is generally understood in the relevant art that mechanical connections between electrical conductors typically are of a greater resistance than either of the conductors themselves. For example, an electrical connection is formed from the first end 144 of the flexible conductor 140 being mechanically connected with the shank 116 by receiving the shank 116 in the opening 152 and applying the nut 199 to the shank 116 to mechanically and electrically connect together the shank 116 and the flexible conductor 140. It is understood, however, that the mechanical connection between the first end 144 and the shank 116 that employs a removable fastener, i.e., the nut 199, generally will have a greater resistance than either the flexible conductor 140 or the shank 116 themselves. When current is applied to a circuit that includes the interruption apparatus 106, the aforementioned mechanical connection with the removable fastener will generate heat. The same can be said for the mechanical and electrical connection between the additional conductor 194 and the rigid conductor 160, which employs the removable central fastener 196. However, by co-forming as a single piece member the flexible conductor 140 and the rigid conductor 160 to form the connection apparatus 104, the generally inseparable connection between the flexible conductor 140 and the rigid conductor 160 generates minimal, if any, heat. Such heat, if any, that is generated at the connection between the flexible conductor 140 and the rigid conductor 160 through the application of current therethrough will be significantly less than, say, the heat that is generated at the mechanical connection between the conductor 40 and the conduction device 36 that is provided by the fasteners 96. The connector apparatus 104 thus generates less heat when incorporated into the interruption apparatus 106 than another conductor because the connection apparatus 104 requires only two mechanical connections that employ removable fasteners whereas another conductor may rely upon three mechanical connections that are provided by removable mechanical fasteners. The co-formed unitary single piece configuration of the connection apparatus 104 thus provides for longer life and reduced wear and tear through reduced resistive heating when current is applied thereto, such as when compared with the connection apparatus 4 and when compared with other previously known conductors employed in a similar application.

Moreover, the co-formed unitary and single-piece configuration of the connection apparatus 104 reduces cost because it is an individual item rather than being separate items that are connected together with removable mechanical fasteners. Fewer parts on hand generally reduces cost. Moreover, the installation of a single piece unitary member on the insulator 110 will typically take less effort than if the connection apparatus 104 were formed of multiple components that needed to be connected together with removable fasteners.

While the peripheral fasteners 198 are employed to affix the rigid conductor 160 and thus the connection apparatus 104 to the insulator 110, such a mechanical connection with removable fasteners does not result in the generation of heat since the rigid conductor 160 and the insulator 110 are not electrically connected together and thus do not have any current flow therebetween. As such, no resistive heating will exist therebetween.

It is also understood that the teachings of the connection apparatus 4 can be combined with the teachings of the connection apparatus 104 to provide a co-formed and unitary single piece connection apparatus that includes the approximately J-shaped conductor 40 and the rigid conductor 160 being co-formed as a single piece member. Such a combination would provide a combination of the advantages mentioned herein.

Figure 10:
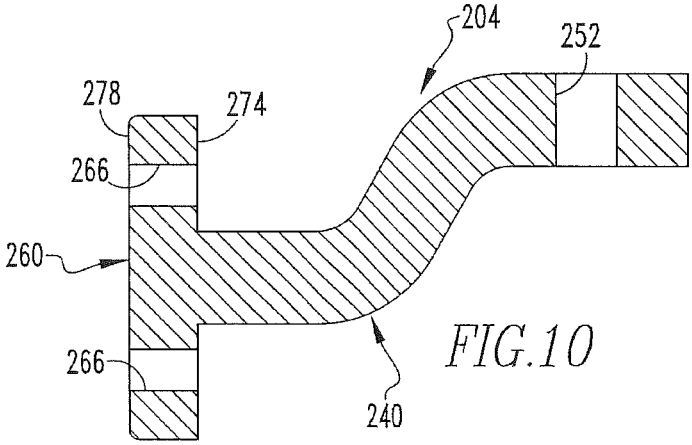
FIG. 10 is a side view, partially cut away, of an improved connection apparatus in accordance with a third embodiment of the disclosed and claimed concept.
Figure 11:
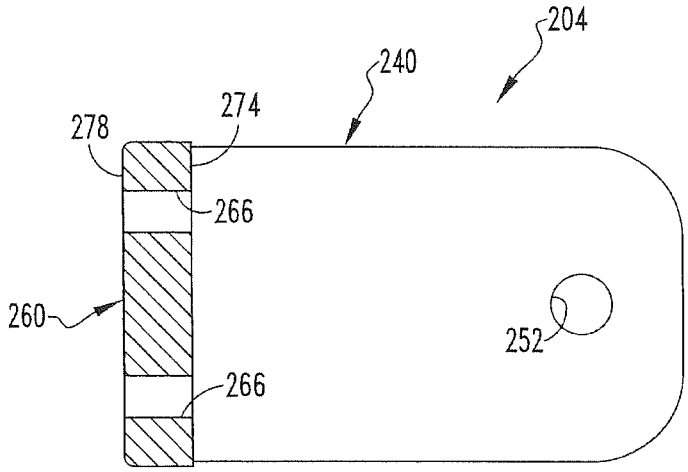
FIG. 11 is a top plan view, partially cut away, of the connection apparatus of FIG. 10.
Figure 12:
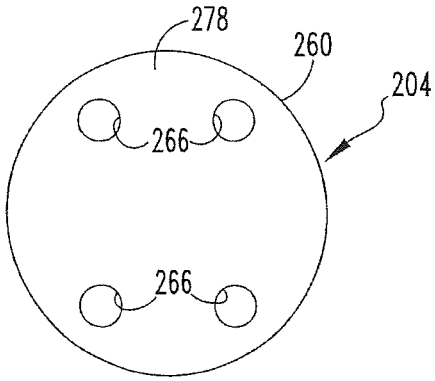
FIG. 12 is an end view of the connection apparatus of FIG. 10.
Figure 13:
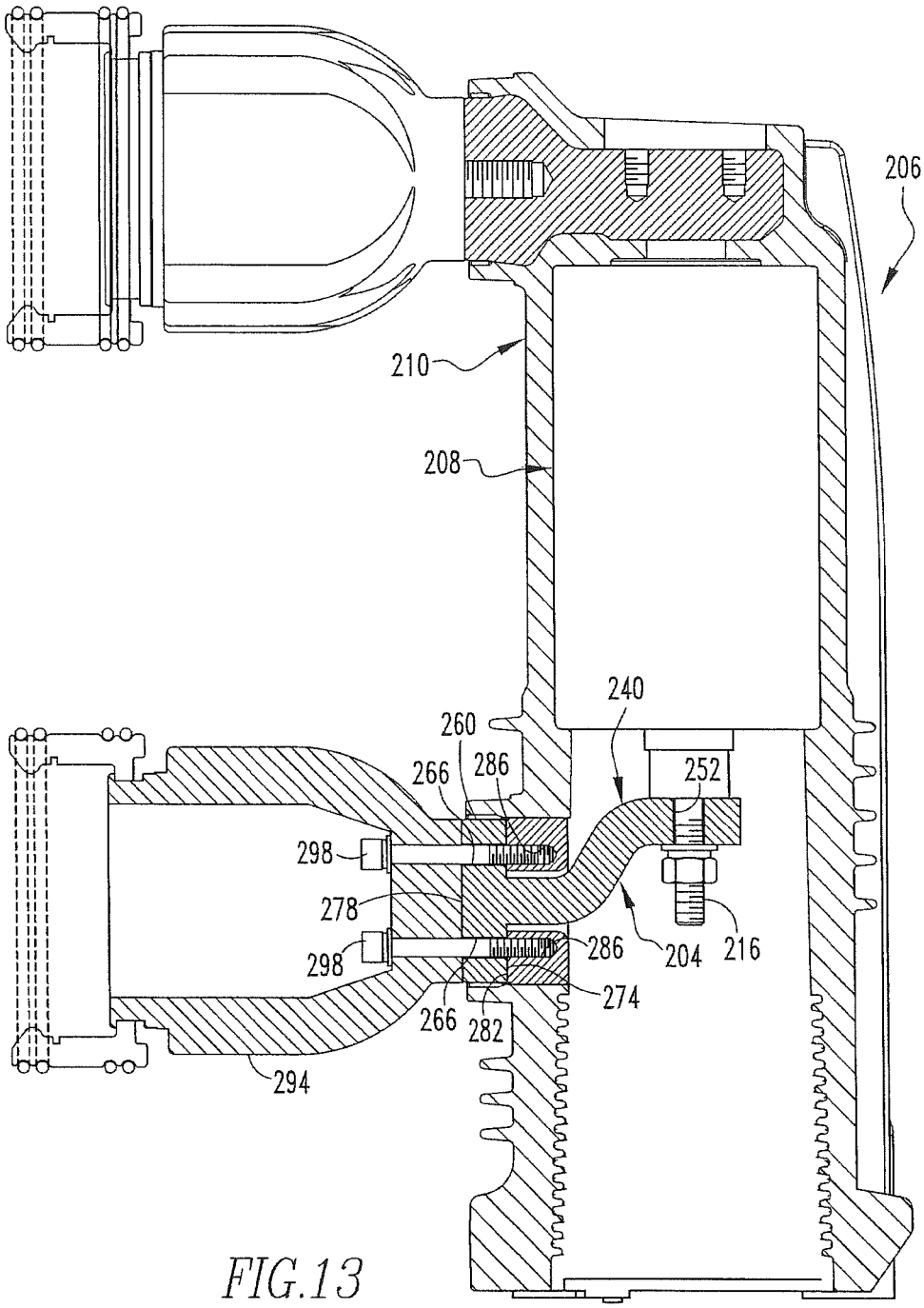
FIG. 13 is a partially cut away side view of an improved interruption apparatus that employs the connection apparatus of FIG. 10.

An improved connection apparatus 204 in accordance with a third embodiment of the disclosed and claimed concept is depicted generally in FIGS. 10-12 and is depicted in FIG. 13 as being incorporated into an improved interruption apparatus 206 that is likewise in accordance with the disclosed and claimed concept. In the depicted exemplary embodiment presented herein, the interruption apparatus 204 includes an insulator 210 upon which is disposed a circuit interrupter 208 having an elongated shank 216 that are essentially identical to the insulator 110, the circuit interrupter 108, and the shank 116. However, the connection apparatus 204 is of a different configuration than the connection apparatus 104 and is connectable in a different fashion with another conductor 294.

More particularly, the connection apparatus 204 includes a flexible conductor 240 and a rigid conductor 260 that are mechanically and electrically connected together and are co-formed as a unitary single piece member in a fashion similar to the connection apparatus 104. However, the rigid conductor 260 does not include the central opening 164 or any other such central opening. While the rigid conductor 260 has a plurality of peripheral openings 266 formed therein, such peripheral openings 266 are depicted herein as being simple thru-bores that do not include the ledges 170 or any other such structure.

When the connection apparatus 204 is installed in the interruption apparatus 206, a first end of the flexible conductor 240 is mechanically and electrically connected with a shank 216 in the fashion of the first end 144 and the shank 116. However, the rigid conductor 260 is not separately affixed to the insulator 210. Rather, a plurality of peripheral fasteners 298 are received in bores formed in the additional conductor 294, and are then received through the peripheral openings 266 and are threadably received in a plurality of threaded receptacles 286 that are formed in an engagement surface 282 of the insulator 210. When the peripheral fasteners 298 are tightened, the rigid conductor 260 is compressively interposed between the additional conductor 294 and the engagement surface 282. That is, the peripheral fasteners 298 not only cause a first surface 274 of the rigid conductor 260 and the engagement surface 282 to be compressively engaged with one another, but the peripheral fasteners 298 additionally cause the additional conductor 294 and a second surface 278 of the rigid conductor 260 that is opposite the first surface 274 to be compressively engaged with one another.

The improved connection apparatus 204 thus provides the same benefits as the connection apparatus 104, but it employs a different attachment methodology. This enables the teachings herein to be employed in different types of applications, i.e., one wherein the additional conductor 194 is used and another where the additional conductor 294 is used. The additional conductors 194 and 294 may be provided by different manufacturers. It can therefore be seen that the connection apparatus 204 and the connection apparatus 104 are both cooperate with the same insulator 210 and circuit interrupter 208. This provides for further cost reduction since it is necessary to keep on hand only a single insulator 210 and circuit interrupter 208 and multiple connection apparatus 104 and 204 rather than being required to keep on hand two different types of insulators. It is also understood that the teachings of the connection apparatus 4 can likewise be combined with those of the connection apparatus 204 to achieve a combination of the advantages of both.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A connection apparatus structured to be electrically connected between a movable conductor of a circuit interrupter and another conductor that is stationary, the movable conductor having an elongated shank that is structured to be connected with an operating mechanism which is structured to move the shank along a movement axis to change the state of the circuit interrupter, the connection apparatus comprising:

an elongated and flexible conductor having formed therein a hole that is elongated along a direction of elongation of the conductor and that is structured to movably receive therein a portion of the shank in a generally non-contacting fashion;

a first end of the conductor forming a first connecter and having formed therein an opening that is structured to receive therein another portion of the shank and to be electrically connected with the another portion of the shank; and a second connector situated at a second end of the conductor and being structured to be electrically connected with the another conductor.

2. The connection apparatus of claim 1 wherein the conductor includes an approximately U-shaped loop portion having a pair of legs and further includes an elongated connection portion that extends from a leg of the pair of legs.

3. The connection apparatus of claim 2 wherein the hole is formed in the leg, and wherein the first connector is situated on another leg of the pair of legs.

4. The connection apparatus of claim 3 wherein the second connector is situated at an end of the connection portion opposite the leg.

5. The connection apparatus of claim 2 wherein the loop portion and the connection portion together are approximately J-shaped.

6. The connection apparatus of claim 1 wherein the conductor is a braid formed of a conductive material.

* * * * *